US010186822B2

(12) United States Patent
Hogan

(10) Patent No.: US 10,186,822 B2
(45) Date of Patent: Jan. 22, 2019

(54) HAND HELD APPLIANCE

(71) Applicant: Dyson Technology Limited, Wiltshire (GB)

(72) Inventor: Benjamin James Hogan, Bristol (GB)

(73) Assignee: Dyson Technology Limited, Malmesbury, Wiltshite (GB)

( * ) Notice: Subject to any disclaimer, the term of this patent is extended or adjusted under 35 U.S.C. 154(b) by 0 days.

(21) Appl. No.: 15/704,530

(22) Filed: Sep. 14, 2017

(65) Prior Publication Data

US 2018/0076591 A1 Mar. 15, 2018

(30) Foreign Application Priority Data

Sep. 15, 2016 (GB) ..... 1615699.4

(51) Int. Cl.
*H01R 39/00* (2006.01)
*A45D 1/00* (2006.01)
(Continued)

(52) U.S. Cl.
CPC ..... *H01R 39/64* (2013.01); *A45D 1/04* (2013.01); *A45D 2/00* (2013.01); *A45D 2/001* (2013.01);
(Continued)

(58) Field of Classification Search
CPC ..... H01R 39/64; H01R 35/02; H01R 39/08; H01R 2201/06; A45D 20/12; A45D 4/08; A45D 2/36
See application file for complete search history.

(56) References Cited

U.S. PATENT DOCUMENTS 4,255,006 A 3/1981 King
4,583,797 A 4/1986 Engelmore et al.
(Continued)

FOREIGN PATENT DOCUMENTS

CN 202633729 12/2012
CN 204067797 12/2014
(Continued)

OTHER PUBLICATIONS

International Search Report and Written Opinion dated Dec. 1, 2017, directed to International Application No. PCT/GB2017/052432; 11 pages.
(Continued)

*Primary Examiner* — Xuong Chung Trans
(74) *Attorney, Agent, or Firm* — Morrison & Foerster LLP

(57) ABSTRACT

A housing and a power cable for supplying power to components within the housing wherein the power cable is attached to the appliance via a rotatable connection, the rotatable connection comprising a male connector having two longitudinally spaced connectors separated by a separator and a female connector comprising two longitudinally spaced receptacles. The two longitudinally spaced receptacles may be substantially identical and may be shaped to receive the longitudinally spaced connectors and may have a base portion and two upstanding portions forming a U-shape. The two upstanding portions may have a first straight section that extends from the base portion and may have a second section which extends from the first section and is adapted to receive a longitudinally spaced connector and may have a third section which extends from the second section and provides an opening into which a longitudinally spaced connector can be inserted.

26 Claims, 4 Drawing Sheets

(51) Int. Cl.

| | |
|---|---|
| ***A45D 2/00*** | (2006.01) |
| ***A45D 4/00*** | (2006.01) |
| ***H01R 39/64*** | (2006.01) |
| ***A45D 1/04*** | (2006.01) |
| ***A45D 6/00*** | (2006.01) |
| ***A45D 20/12*** | (2006.01) |
| ***A45D 20/30*** | (2006.01) |
| ***H01R 39/12*** | (2006.01) |
| ***H01R 39/24*** | (2006.01) |
| *H01R 103/00* | (2006.01) |

(52) U.S. Cl.

CPC ..... *A45D 6/00* (2013.01); *A45D 20/12* (2013.01); *A45D 20/30* (2013.01); *H01R 39/12* (2013.01); *H01R 39/24* (2013.01); *H01R 2103/00* (2013.01)

(56) References Cited

U.S. PATENT DOCUMENTS

| | | | | |
|---|---|---|---|---|
| 5,409,403 | A * | 4/1995 | Falossi | H01R 24/38 439/21 |
| 6,152,636 | A * | 11/2000 | Nass | B60J 1/17 403/13 |
| 6,827,601 | B1 | 12/2004 | Haeberle | |
| D530,286 | S | 10/2006 | Phung et al. | |
| 2010/0089413 | A1* | 4/2010 | Wright | A45D 2/001 132/211 |
| 2015/0024610 | A1 | 1/2015 | Pollner | |

FOREIGN PATENT DOCUMENTS

| | | |
|---|---|---|
| CN | 204517018 | 7/2015 |
| DE | 10 2012 204 830 | 9/2013 |
| EP | 0 254 157 | 1/1988 |
| EP | 0 711 007 | 5/1996 |
| GB | 1 544 960 | 4/1979 |
| JP | 53-29853 | 3/1978 |
| JP | 57-30777 | 7/1982 |
| JP | 62-123701 | 8/1987 |
| JP | 62-217511 | 9/1987 |
| KR | 10-2014-0138066 | 12/2014 |

OTHER PUBLICATIONS

Search Report dated Feb. 15, 2017, directed to GB Application No. 1615699.4; 1 page.

* cited by examiner

HAND HELD APPLIANCE

REFERENCE TO RELATED APPLICATIONS

This application claims the priority of United Kingdom Application No. 1615699.4, filed Sep. 15, 2016, the entire contents of which are incorporated herein by reference.

FIELD OF THE INVENTION

This invention relates to a rotating connection between a hand held appliance and a power cable and in particular for a hair care appliance.

BACKGROUND OF THE INVENTION

Power cables on hand held appliances have two forms. Firstly where rotation of the appliance with respect to a user is unlikely such as with power tools or hairdryers. Secondly where rotation of the appliance with respect to the user is important to the function of the appliance such as hot styling appliances, straighteners and curling devices such as tongs, wands or irons. There is a requirement to provide a continuously rotating electrical connection in the second case so that power from a power cable can be provided to a heater and/or fan unit within the appliance without significant loss of contact otherwise the user could perceive a loss of connection by a drop in temperature and/or flow rate or a longer styling time.

SUMMARY OF THE INVENTION

According to certain aspects, the present invention seeks to provide improved electrical connection between a power cable and a hand held appliance capable of having a continuously rotatable connection. In addition, according to certain aspects, the invention seeks to provide a rotatable connection in which the male connector cannot be removed unless the product is at least partly disassembled.

According to a first aspect, the invention provides a rotatable connection between a power cable and a hand held appliance comprising a male connector having two longitudinally spaced connectors separated by a separator and a female connector comprising two longitudinally spaced receptacles.

According to certain aspects, the invention provides a hand held appliance comprising a housing and a power cable for supplying power to components within the housing wherein the power cable is attached to the appliance via a rotatable connection, the rotatable connection comprising a male connector having two longitudinally spaced connectors separated by a separator and a female connector comprising two longitudinally spaced receptacles.

Preferably, the two longitudinally spaced receptacles are substantially identical.

In a preferred embodiment, the two longitudinally spaced receptacles are the same shape. Preferably, the two longitudinally spaced receptacles are the same size.

Preferably, the two longitudinally spaced receptacles are shaped to receive the longitudinally spaced connectors.

Preferably, the two longitudinally spaced receptacles have a base portion and two upstanding portions forming a U-shape. In a preferred embodiment, the two upstanding portions have three sections, a first straight section that extends from the base portion. A second section which extends from the first section and is adapted to receive a longitudinally spaced connector. A third section which extends from the second section and provides an opening into which a longitudinally spaced connector can be inserted.

Preferably, the second section is curved. In a preferred embodiment, the second section is convex i.e. it curves out from the base portion. Where the second section meets the third section of the upstanding portion, the distance between the upstanding portions of a receptacle is less than the diameter of a longitudinally spaced connector. This feature helps to retain the male connector within the receptacles. The third section preferably flares out to receive the longitudinally spaced connectors. The two longitudinally spaced receptacles are flexible and slightly springy to assist in both the insertion of the longitudinally spaced connectors and the retention of the longitudinally spaced connectors within the longitudinally spaced receptacles.

Preferably, at least one of the two longitudinally spaced receptacles comprises two or more independently movable fingers which contact a connector. In a preferred embodiment, the two upstanding portions of a receptacle each comprise at least two parts which can be considered as fingers extending from the base portion. Thus, in this embodiment, the upstanding portions are split to provide two or more separate connections to a single connector. The upstanding portions are split longitudinally to provide multiple contacts each of which are independent thus, as the connection rotates, each part of an upstanding portion can flex independently with respect to the connector. This decreases the potential for a loss of signal between the rotatable connection or the length of time of any loss of signal. A loss of signal results in a power loss to the appliance and this can cause difficulties Many rotatable connectors have two or more receptacles spaced along a longitudinal axis with the connection being made by a movement along that longitudinal axis. In contrast, the present invention provides a rotatable connector where the two receptacles are spaced along a longitudinal axis but the connection is made by the male connector moving orthogonal to the longitudinal axis.

Thus, according to a second aspect, the invention provides a rotatable connection between a power cable and a hand held appliance comprising a male connector and a female connector wherein the female connector extends along a longitudinal axis and wherein the male connector is connected to the female connector by insertion of the male connector orthogonal to the longitudinal axis.

According to certain aspects, the invention provides a hand held appliance comprising a housing and a power cable for supplying power to components within the housing wherein the power cable is attached to the appliance via a rotatable connection, the rotatable connection comprising a male connector and a female connector wherein the female connector extends along a longitudinal axis and wherein the male connector is connected to the female connector by insertion of the male connector orthogonal to the longitudinal axis.

Preferably, the appliance comprises a housing which includes a holder for retaining the female connector with respect to the housing. It is preferred that the holder is provided in two parts and the male connector is inserted into a first part of the holder. Once the male connector has been inserted, the second part of the holder is attached to the first part retaining the male connector within the housing.

Preferably, the power cable is attached to the male connector and the holder comprises an aperture to enable the power cable to exit from the appliance. Preferably the holder comprises an aperture at one end adapted to receive and retain the male connector. It is preferred that both the first part and the second part of the holder comprise a portion of the aperture.

In a preferred embodiment, the holder comprises a first compartment and a second compartment. Preferably, one of the two longitudinally spaced apart receptacles is located within one of the first and the second compartments. In a preferred embodiment, the first compartment is separated from the second compartment by a dividing wall. Preferably the dividing wall extends radially inwards of the housing and substantially orthogonal to the longitudinal axis of the female connector. The holder functions to retain each of the two longitudinally spaced apart receptacles with respect to the housing and to maintain separation of the two electrical connections made.

It is preferred that the female connector is provided at an end of the body.

Preferably, the longitudinally spaced connectors are the same diameter.

In a preferred embodiment, the male connector provides a bearing surface which extends radially around the male connector. This facilities the relative rotation of the power cable and appliance. In one embodiment, the male connector has a first end and a second end and the bearing surface is adjacent the first end of the male connector. The first end connects to the power cable. Conventionally, a strain relief is provided along a short length of the power cable to provide strength and resilience to the forces put on the power cable adjacent the appliance and thus adjacent the first end of the male connector. Preferably, the bearing surface is a collar that extends around the diameter of the male connector. Preferably the bearing surface engages with a ring that extends around the holder. Preferably the ring is an inner surface of the aperture in the holder.

It is preferred that the second bearing surface is linearly spaced along the male connector from the bearing surface. This second bearing surface helps to retain the axial alignment of the relative rotation. It is preferred that the bearing surface and the second bearing surface are located one at or near each end of the male connector. Thus, the two longitudinally spaced connectors are located between the bearing surface and the second bearing surface. The bearing surface and optional second bearing surface have a larger diameter than the two longitudinally spaced connectors. Preferably, the second bearing surface is located at or near the second end of the male connector. This maximises the stability of the male connector as it rotates with respect to the appliance.

Preferably, the male connector provides a retention feature. It is of greater diameter than a longitudinally spaced connector and bearing surface, if provided. Preferably the retention feature is adjacent the first bearing surface. Conveniently this prevents removal of the male connector from the appliance when a force is applied to the power cable.

The retention feature will suffer from wear during use of the appliance so in a preferred embodiment, should the retention feature become damaged, the second retention feature will prevent the male connector from being fully removed from the appliance. Alternatively, the second retention feature is provided adjacent the separator.

The bearing surfaces, separator and retention features are all overmoulded onto a conductive pin. Thus, it is preferred that the bearing surface and retention feature are provided as a single moulded part. Additionally the second retention feature and either the second bearing surface or separator are moulded as a single part with the second retention feature, if provided.

In a preferred embodiment, the appliance is a hair care appliance and preferably, a hot styling device.

BRIEF DESCRIPTION OF THE DRAWINGS

The invention will now be described by way of example, and with reference to the accompanying drawings, of which.

DETAILED DESCRIPTION OF THE INVENTION

Figure 1:
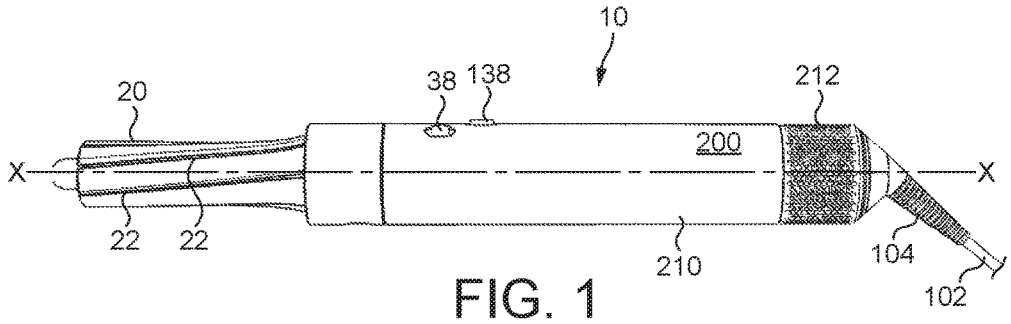
FIG. 1 shows an example of an appliance on which a strain relief according to the invention can be used.

Referring to FIG. 1, an example of a hand held appliance 10 is shown. The appliance has a handle 210 and an attachment 20 for styling hair. In order to enable a user to create different styles and to give the appliance multi functionality, the attachment 20 is removable and can be replaced with an alternative attachment. In addition, the attachment 20 can be removed to allow easier storage of the appliance when not in use. The handle 210 includes a number of different user operated buttons 38, 138 enabling the user to select between a number of different heat and flow settings. The handle 210 typically includes a fan unit and heater. In use the fan unit draws fluid in through a fluid inlet 212, through the heater which optionally heats the fluid which is then emitted by the fluid outlet 22 in the attachment 20.

Figure 2A:
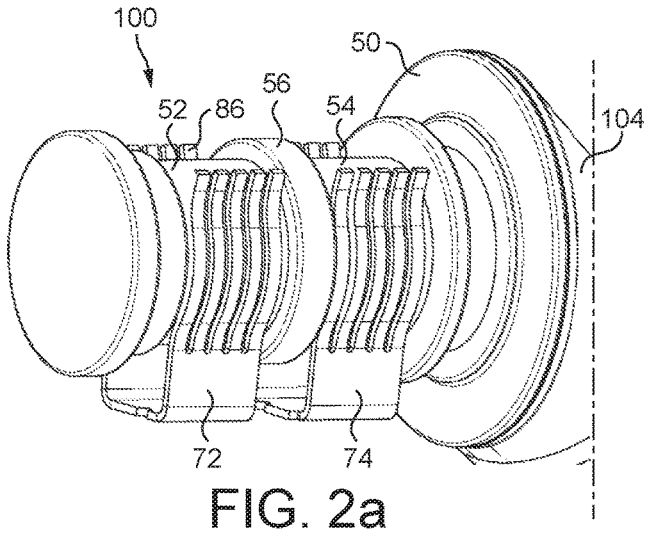
FIG. 2*a* shows an isometric view of a strain relief according to the invention.
Figure 2B:
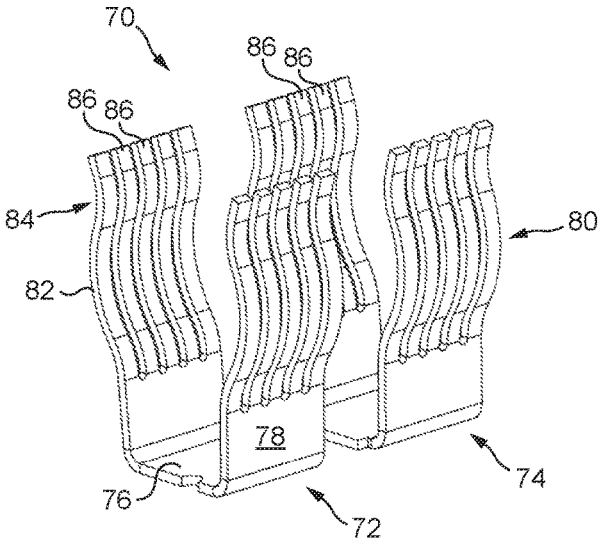
FIG. 2*b* shows an isometric view of the female connector of FIG. 2*a;*
Figure 2C:
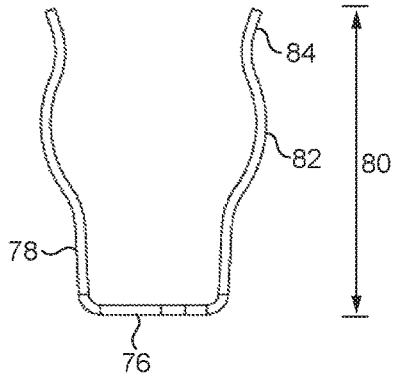
FIG. 2*c* shows a cross sectional view through the female connector of FIG. 2*b;*

Referring now to FIGS. 2*a* to 2*c*, the appliance 10 is powered using a mains supply and a power cable 102 which is attached to the appliance at the fluid inlet 212 and connects to internal wiring via an electrical connection 100. The electrical connection 100 has two parts, a male connector 50 and a female connector 70. The male connector 50 is attached to the power cable 102 and in order to reduce the strain on the power cable 102 at and around the point of entry into the appliance a strain relief 104 is provided adjacent the male connector 50. When the electrical connection 100 is rotated during use, the strain relief 104 reduces the strain on the power cable 102.

Figure 7:
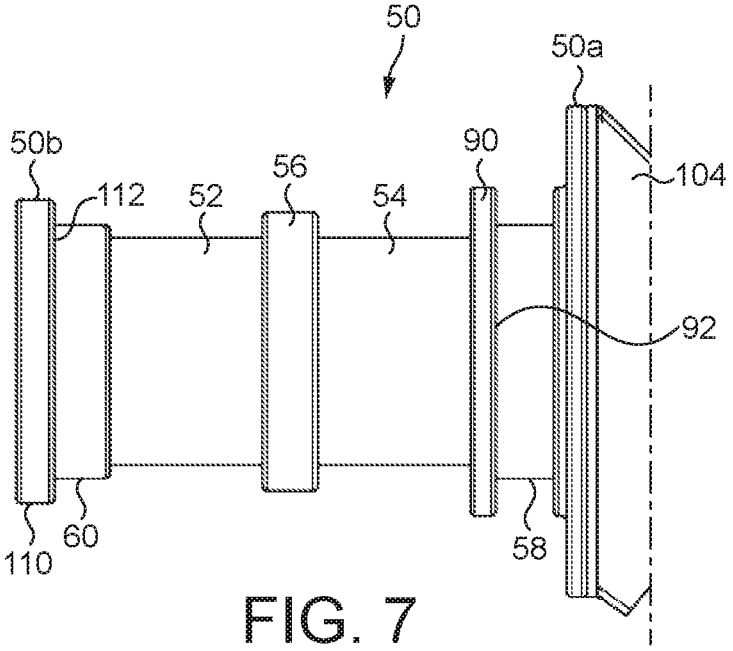
FIG. 7 shows a side view of the male connector shown in FIG. 2*a*.

Referring now to FIGS. 2*a* and 7 in particular, features of the electrical connector 100 will be discussed. The power cable 102 contains two wires, one a live wire and the other a neutral wire. The male connector 50 is essentially cylindrical and includes two connectors 52, 54 which are longitudinally spaced. In this embodiment a first connector 52 is the live connection and a second connector 54 is the neutral connection which connects to corresponding wires from the power cable 102. A separator 56 is provided between the first electrical connection 52 and the second electrical connection 54 isolating the two electrical connections.

The female connector will now be introduced, referring in particular to FIGS. 2*a* to 2*c*. The female connector 70 comprises a first receptacle 72 into which the first connector 52 is received and a second receptacle 74 into which the second connector 54 is received. As with the first and second connectors 52, 54, the first and second receptacles 72, 74 are longitudinally spaced apart. In this embodiment, as the first and second connectors are essentially identical, the first and second receptacles are also identical.

The first and second receptacles 72, 74 are shaped so as to enable insertion of the first and second connectors 52, 54 and then to retain the first and second connector 52, 54 to maintain electrical contact. The first and second receptacles 72, 74 are essentially "U"-shaped having a base portion 76 and a pair of arms or upstanding portions 80 which extend away from the base portion 76. A first straight portion 78 extends from the base portion 76 this provides a limit for the insertion of the male connector 50 into the female connector 70. A second section 82 extends from the first section 78 and this second section 82 is adapted to receive the male connector 50 and to retain it within the female connector 70. This second section 82 is curved and convex and is adapted to receive the male connector 50 and in particular one of the first or second connectors 52, 54. A third section 84 extends from the second section 82 and this third section 84 tapers outwardly to allow the male receptacle to be funnelled towards the second section 82.

The first and second receptacles 72, 74 are slightly springy to enable both insertion of the male connector 50 and maintenance of electrical contact between a respective receptacle 72, 74 and connector 52, 54. The upstanding portions 80 flex outwards then back inwards to contact one of the first and second connectors 52, 54.

In this embodiment, the female connector 70 is non-continuous and in fact comprises a number of different connection fingers 86 which extend towards the third portion. In effect, the female connector 70 is split into a multitude of different connection regions along each of the fingers 86. Each upstanding portion 80 is split into the multitude of individually moveable connection fingers 86 along the second and third portions 82, 84. This improves the reliability of the connection as each of the connection fingers 86 acts as a separate upstanding portion 80 providing a multitude of points of contact.

Figure 6:
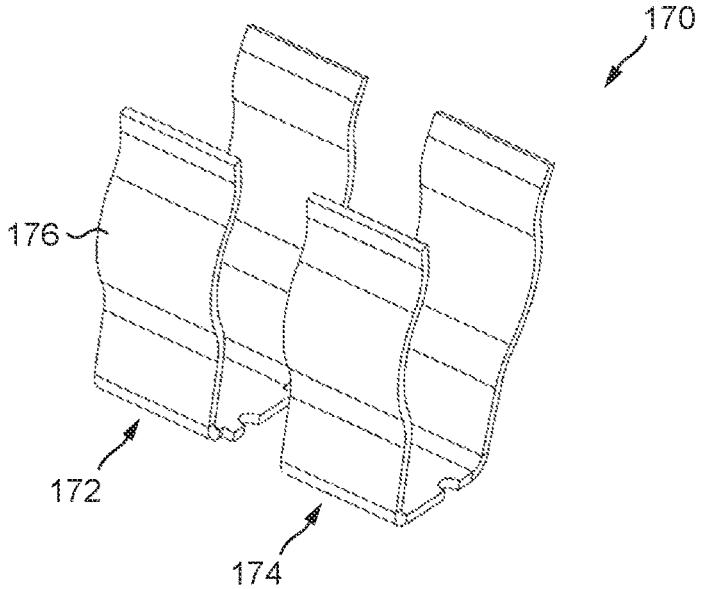
FIG. 6 shows an isometric view of an alternate female connector.

Referring now to FIG. 6, an alternative female connector 170 is shown. The alternative female connector 170 has solid receptacles 172, 174, i.e., each receptacle is continuous along the length of an upstanding portion 176. The solid receptacles 172, 174 are shaped as previously described to both aid insertion of the first or second connector 52, 54 and the retention of the first or second connector 52, 54 within the respective receptacle. These solid receptacles 172, 174 maintain an adequate contact with the first and second connectors 52, 54 and as they do not require a further process step to produce the fingers 86 of the first described receptacles 72, 74 they are cheaper to produce however, where a near continuous power supply is required to run internal components of the appliance, the fingers 86 of the first described receptacles 72, 74 are preferred. In addition, as the components wear over time the reliability of the solid receptacles 172, 174 is reduced compared with that of the fingers 86 of the first described receptacles 72, 74.

Both of the female receptacles shown 70, 170 are completely interchangeable. The invention will be described with reference to two different male connectors. Male connector 50 which is shown alone in FIG. 7 and inserted into an appliance in FIG. 4 and alternative male connector 150 shown alone in FIG. 8 with a corresponding holder in FIG. 5. As many of the features of the male connector 50 and alternative male connector 150 are common the same reference numerals will be used. The main differences relate to the location of retention features for preventing removal of the male connector 50 and alternative male connector 150 from the appliance 10.

Figure 3:
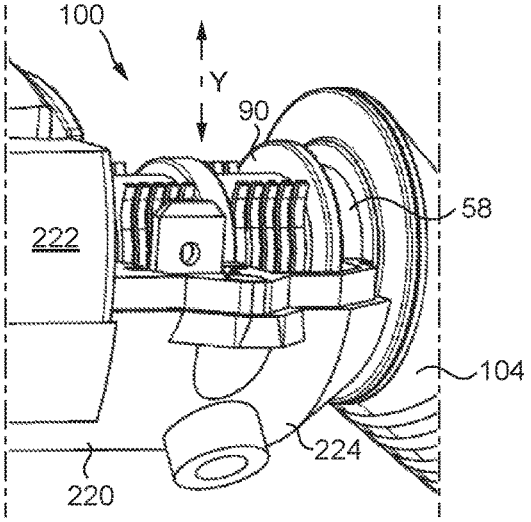
FIG. 3 shows an isometric view of a strain relief partially enclosed in a housing in the appliance of FIG. 1.
Figure 4:
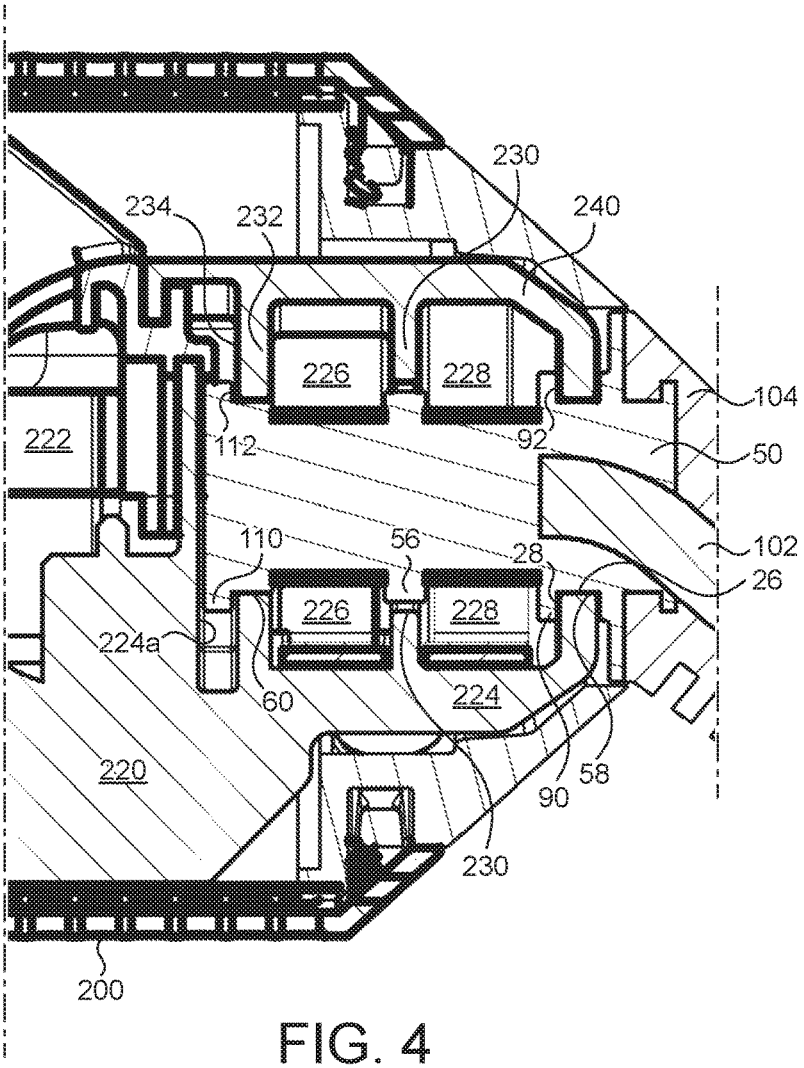
FIG. 4 shows a cross section through the appliance of FIG. 1.
Figure 5:
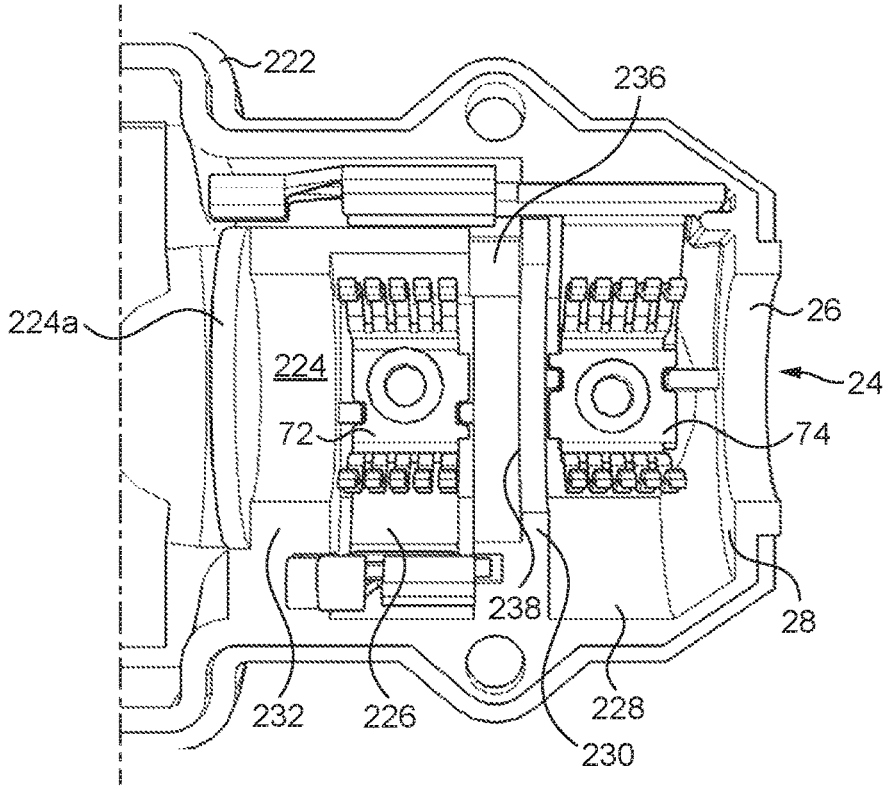
FIG. 5 shows a top view into the holder shown in FIG. 4.

Referring in particular to FIGS. 3 to 5, the handle 210 has an outer wall 200 and an inner wall 220. The inner wall 220 has a number of functions including providing a housing 222 for internal components of the appliance and the electrical connection 100.

The electrical connection 100 herein described is designed not to be removed by a user. In fact for increased robustness of the electrical connection 100 instead of being inserted longitudinally as with many connections on hand held appliances, this electrical connection 100 is inserted orthogonal to the longitudinal axis X-X of the appliance. The housing 222 is provided with a holder 224 for retaining the female connector 70 with respect to the housing. The holder is split into a first compartment 226 into which the first receptacle 72 is located and a second compartment 228 into which the second receptacle 74 is located. The first compartment 226 and the second compartment 228 are separated by an internal wall 230. The first compartment 226 is defined by the internal wall 230 and a radial wall 232 which is at or near the internal end 224*a* of the holder 224. Both the internal wall 230 and the radial wall 232 can be considered to be a ring that extends around an inner surface of the holder 224.

In addition, the holder 224 comprises an aperture 24 at one end. This aperture 24 is defined by a rim 26 which extends radially around the holder 224 and holder cover 240 and provides an entry point for the power cable 102 into the appliance.

In order to attach the male connector 50 to the female connector 70, the male connector 50 is inserted along axis Y-Y into the holder 224. Once the first connector and second connector have been correctly inserted into the first receptacle 72 and the second receptacle 74 respectively, a holder cover 240 is placed over the male connector 50. The holder cover 240 compliments the first compartment 226, second compartment 228 and internal wall 230 so that within the holder 224 the internal wall 230 extends continuously radially between the first compartment 236 and the second compartment 238.

In order that the electrical connector 100 can rotate continuously with respect to the housing 222, the male connector 50 and the holder 224 are provided with bearing surfaces.

The male connector 50 extends longitudinally and has a first end 50*a* adjacent the strain relief 104 and a second end 50*b* distal to the strain relief 104. A first bearing surface 58 is provided adjacent the first end 50*a*. The first bearing surface 58 extends radially around the male connector having a diameter which is greater than that of the first and second electrical connectors 52, 54. To give axially stability of the male connector 50 as it rotates with respect to the female connector 70 a second bearing surface 60 is provided axially spaced from the first bearing surface 58. In this embodiment the second bearing surface 60 is near the second end 50*b* of the male connector 50. Having the first and second bearing surfaces 58, 60 axially spaced along the male connector 50 provides stability to the connection and helps to retain axial alignment of the male connector 50 with respect to the appliance 10.

The first and second bearing surfaces 58, 60 can be considered to be collars that extend radially around the male connector and the collars have a greater diameter than the first and second connectors 52, 54. The first bearing surface 58 engages with the rim 26 of the aperture 24 in the housing 222. The second bearing surface 60 engages with the radial wall 232.

The male connector 50 and alternative male connector 150 also include retention features which are adapted to prevent the removal of the male connector 50 through the aperture 24. A first retention collar 90 is provided adjacent the first bearing surface 58, between the first bearing surface 58 and the second connector 54. The first retention collar 90 has a larger diameter that the aperture 24 and the first bearing surface 58. During normal use a side surface 92 of the first retention collar 90 will slide against an inner surface 28 of the aperture 24 as the male connector 50 rotates with respect to the appliance 10.

A second retention collar 110 is provided. The second retention collar 110 is provided as a second means to prevent removal of a male connector 50, 150 from the appliance 10. As the first retention collar 90 will wear over time there is a possibility that eventually it will fail thus the second retention collar 110, is a back-up. This second retention collar 110 is provided in different locations on the male connector 50 and alternative male connector 150.

Referring now to FIG. 7 in particular, the male connector 50 has a second retention collar 110 which is located at the second end 50*b* adjacent the second bearing surface 60. The second retention collar 110 is of greater diameter than the second bearing surface 60 and is, in this embodiment, about the same diameter as the first retaining collar 90. A side surface 112 of the second retention collar 110 engages with a side surface 234 of the radial wall 232.

Figure 8:
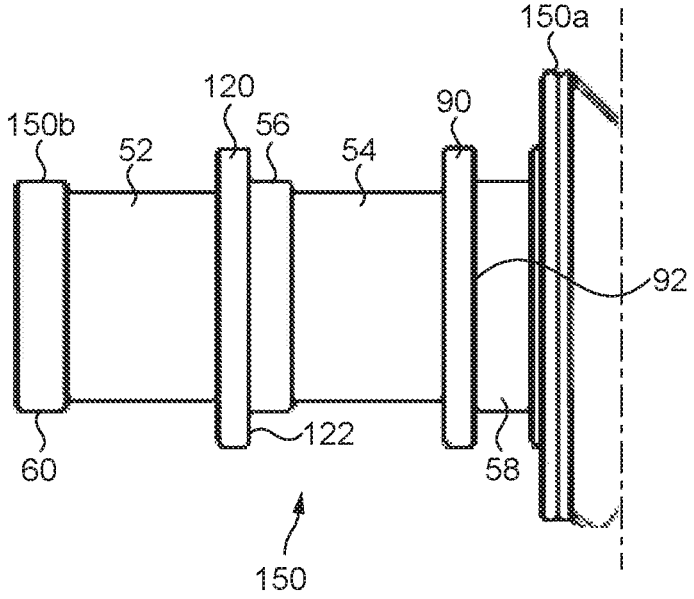
FIG. 8 shows a side view of an alternative male connector.

Referring now to FIG. 8, the alternative male connector 150 also includes a second retention collar 120 however, this second retention collar 120 is adjacent the separator 56 and in this embodiment between the separator 56 and the first connector 52. The holder 224 includes a second internal wall 236 adjacent the internal wall 230 but which extends radially into the cavity of the holder 224 less than the separator 230. A side surface 122 of the second retention collar 120 engages with a side surface 238 of the internal wall 230.

The male connector 50 and alternative male connector 150 are made from a cylindrical pin onto which the separator 56, first and second bearing surfaces 58, 60 and first and second retention collars 90, 110, 120 are overmoulded. The overmoulded parts are made from a low friction material having high wear resistance such as glass filled POM however, it will be apparent to the skilled person that other polymeric materials are suitable.

Whilst the invention has been described with reference to a hot styling device, the rotatable connector can be used in any hand held appliance in which a relative rotation of the appliance with respect to a user occurs including, but not limited to straighteners and curling devices such as tongs, wands or irons. In these examples, as a fluid flow is not used in the styling process, the handle 210 would not include a fan unit but would include a heater or heated surface with which to style hair.

The invention claimed is:

1. A hand held appliance comprising a housing and a power cable for supplying power to components within the housing, wherein the power cable is attached to the appliance via a rotatable connection, the rotatable connection comprising a male connector having two connectors spaced in a longitudinal direction and separated by a separator, and a female connector comprising two longitudinally spaced receptacles, wherein at least one of the two longitudinally spaced receptacles comprises a base having a length that extends in the longitudinal direction and two or more independently movable fingers that extend parallel to one another from the base in a direction that is perpendicular to the longitudinal direction and contact at least one of the two longitudinally spaced connectors.

2. The appliance of claim 1, wherein the two longitudinally spaced receptacles are identical.

3. The appliance of claim 1, wherein the two longitudinally spaced receptacles are shaped to receive the longitudinally spaced connectors.

4. The appliance of claim 1, wherein the two longitudinally spaced receptacles have a base portion and two upstanding portions forming a U-shape.

5. The appliance of claim 4, wherein the two upstanding portions have a first straight section that extends from the base portion.

6. The appliance of claim 5, wherein the two upstanding portions have a second section which extends from the first section and is adapted to receive a longitudinally spaced connector.

7. The appliance of claim 5, wherein the two upstanding portions have a third section which extends from the second section and provides an opening into which a longitudinally spaced connector can be inserted.

8. A hand held appliance comprising a housing and a power cable for supplying power to components within the housing, wherein the power cable is attached to the appliance via a rotatable connection, the rotatable connection comprising a male connector and a female connector, wherein the female connector extends along a longitudinal axis and comprises two longitudinally spaced receptacles that are located in two compartments separated by a radially inwardly extending wall, and wherein the male connector comprises two longitudinally spaced connectors separated by a separator and the male connector is connected to the female connector by insertion of the male connector orthogonal to the longitudinal axis such that the separator aligns with the radially inwardly extending wall.

9. The appliance of claim 1, wherein the housing comprises a holder for retaining the female connector with respect to the housing.

10. The appliance of claim 9, wherein the holder is provided in two parts and the male connector is inserted into a first part of the holder.

11. The appliance of claim 9, wherein the holder comprises an aperture at one end adapted to receive and retain the male connector.

12. The appliance of claim 1, wherein the male connector provides a bearing surface which extends radially around the male connector.

13. The appliance of claim 12, wherein the male connector has a first end and a second end and the bearing surface is adjacent the first end of the male connector.

14. The appliance of claim 12, wherein the bearing surface is a collar that extends around the diameter of the male connector.

15. The appliance of claim 12, wherein the bearing surface engages with a ring that extends around the holder.

16. The appliance of claim 15, wherein the holder comprises an aperture at one end adapted to receive and retain the male connector and the ring is an inner surface of the aperture.

17. The appliance of claim 13, wherein a second bearing surface is provided.

18. The appliance of claim 17, wherein the second bearing surface is located at or near the second end of the male connector.

19. The appliance of claim 1, wherein the male connector provides a retention feature.

20. The appliance of claim 19, wherein the retention feature is a retaining ring extending around the male connector.

21. The appliance of claim 20, wherein the holder comprises an aperture at one end adapted to receive and retain the male connector and the retaining ring abuts an inner surface of the aperture and is of a larger diameter than the aperture.

22. The appliance of claim 19, wherein a second retention feature is provided.

23. The appliance of claim 22, wherein the male connector has a first end and a second end and the second retention feature is provided at or near the second end of the male connector.

24. The appliance of claim 22, wherein the male connector has a first end and a second end and the second retention feature is provided adjacent the separator.

25. The appliance of claim 1, wherein the appliance is a hair care appliance.

26. The appliance of claim 25, wherein the hair care appliance is a hot styling appliance.

* * * * *